US009415918B2

(12) United States Patent
Montarras et al.

(10) Patent No.: US 9,415,918 B2
(45) Date of Patent: Aug. 16, 2016

(54) PACKAGING FOR CONSUMABLE PRODUCTS AND METHODS FOR USING SAME

(71) Applicants: Marc Montarras, Pully (CH); Barry Longson, Chardonne (CH)

(72) Inventors: Marc Montarras, Pully (CH); Barry Longson, Chardonne (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 13/920,278

(22) Filed: Jun. 18, 2013

(65) Prior Publication Data

US 2013/0341350 A1 Dec. 26, 2013

Related U.S. Application Data

(60) Provisional application No. 61/663,044, filed on Jun. 22, 2012.

(51) Int. Cl.

| | |
|---|---|
| ***B65D 35/00*** | (2006.01) |
| ***B65D 75/58*** | (2006.01) |
| ***B65D 75/30*** | (2006.01) |
| ***B65D 85/72*** | (2006.01) |

(52) U.S. Cl.

CPC ..... *B65D 75/58* (2013.01); *B65D 75/30* (2013.01); *B65D 75/5811* (2013.01); *B65D 85/72* (2013.01)

(58) Field of Classification Search

CPC .... B65D 75/58; B65D 85/72; B65D 75/5811; B65D 75/30; B65D 35/44; B65D 2575/3227; B65D 75/5866; B65D 47/2031; A61J 1/067; A47K 5/1201; A47K 5/122

USPC ..... 222/92, 107, 212, 491, 494, 541.6, 222/541.9, 547, 564; 138/40, 44

See application file for complete search history.

(56) References Cited

U.S. PATENT DOCUMENTS

| | | | | | |
|---|---|---|---|---|---|
| 3,635,376 | A | * | 1/1972 | Hellstrom | 222/107 |
| 3,815,794 | A | * | 6/1974 | Carlisle | 222/491 |
| 3,878,977 | A | * | 4/1975 | Carlisle | 222/491 |
| 4,252,257 | A | * | 2/1981 | Herzig | 222/213 |
| 4,328,912 | A | * | 5/1982 | Haggar et al. | 222/212 |
| 4,592,493 | A | * | 6/1986 | Smith | 222/212 |
| 5,411,178 | A | * | 5/1995 | Roders et al. | 222/105 |
| 5,839,609 | A | * | 11/1998 | Zakensberg | 222/107 |

(Continued)

FOREIGN PATENT DOCUMENTS

| | | |
|---|---|---|
| DE | 1056953 | 5/1959 |
| DE | 20319592 | 4/2004 |
| EP | 1777173 | 4/2007 |

OTHER PUBLICATIONS

International Search Report and Written Opinion dated Nov. 18, 2013 from corresponding PCT Application No. PCT/IB2013/055010.

*Primary Examiner* — Patrick M Buechner
(74) *Attorney, Agent, or Firm* — Gary M. Lobel

(57) ABSTRACT

Packages for housing consumable products and methods of using same are provided. The packages may be customized, functional packages that are designed to prevent accidental spillage or leakage of a flowable consumable product housed therein when the package is opened or during consumption of the product from the package. In a general embodiment, flexible packages are provided and include a body defining a cavity for housing a flowable product, a channel for dispensing the flowable product from the cavity, and a releasable seal that blocks the channel under the application of light pressure, such as occurs during opening the package, but unblocks the channel under heavier pressure, such as occurs during consumption of the product.

7 Claims, 1 Drawing Sheet

(56) References Cited

U.S. PATENT DOCUMENTS

| | | | | |
|---|---|---|---|---|
| 6,357,631 | B1 * | 3/2002 | Zaksenberg | 222/212 |
| 6,776,307 | B1 * | 8/2004 | Hagihara | 222/107 |
| 6,932,241 | B2 * | 8/2005 | Hagihara | 222/92 |
| 2004/0159674 | A1 * | 8/2004 | Hagihara | 222/107 |
| 2010/0051646 | A1 | 3/2010 | Castillo | |
| 2010/0147885 | A1 * | 6/2010 | Braxton et al. | 222/106 |
| 2013/0341350 | A1 * | 12/2013 | Montarras et al. | 222/92 |
| 2014/0197202 | A1 * | 7/2014 | Soh et al. | 222/107 |

* cited by examiner

PACKAGING FOR CONSUMABLE PRODUCTS AND METHODS FOR USING SAME

BACKGROUND

The present disclosure relates generally to packaging. More specifically, the present disclosure relates to containers for storing consumable products and methods of using same.

Packages for consumable products come in a variety of sizes, shapes, materials and designs. Consumable product packages having certain functional features, however, can provide advantages to a user of such packages in addition to possible aesthetic and marketing advantages. The sizes, shapes, materials, designs, and functional features differ, for example, for aesthetic reasons or for reasons related to the products the packaging is intended to house. For example, a flexible package designed to house a solid, consumable bar product would not likely be sufficient to house a sterile gel product. As such, consumable product packaging should be designed for a specific functionality and/or a specific type of food product that the packaging is intended to house.

SUMMARY

The present disclosure is related to packages for housing consumable products. The packages may be customized, functional packages that are designed to prevent accidental spillage or leakage of a flowable consumable product housed therein. In a general embodiment, flexible packages are provided. The flexible packages include a body defining a cavity for housing a flowable product and a channel for dispensing the flowable product from the cavity, the channel being blocked by a releasable seal. The seal blocks the channel upon application of light pressure and the seal unblocks the channel upon application of heavy pressure.

In an embodiment, the pressure needed to cause the seal to block the channel is the pressure created by a user holding the flexible package.

In an embodiment, the pressure needed to cause the seal to block the channel is the pressure created by a user opening the flexible package.

In an embodiment, the pressure needed to cause the seal to unblock the channel is the pressure created by a user squeezing the flexible package.

In an embodiment, the channel has a closed end.

In an embodiment, the body is configured to hold at least one flowable consumable product selected from the group consisting of a gel, liquid, semi-solid, or combinations thereof. In an embodiment, the gel may be a performance gel. In an embodiment, the flowable consumable product may be a puree.

In another embodiment, flexible packages are provided. The flexible packages include a body defining a cavity for housing a liquid product and a channel for dispensing the liquid product from the cavity. The channel has a closed end and a seal in the channel that is constructed and arranged such that the seal prevents a liquid from flowing out of the channel when the flexible package is opened.

In an embodiment, the liquid may be a liquid for nutritional supplementation for an athlete.

In yet another embodiment, flexible packages are provided. The flexible packages include a body defining a cavity for housing a liquid product and a channel for dispensing the gel product from the cavity. The channel has a closed end and a seal in the channel that is constructed and arranged such that the seal prevents a gel from flowing out of the channel when the flexible package is opened.

In yet another embodiment, flexible packages are provided. The flexible packages include a body defining a cavity for housing a liquid product and a channel for dispensing the gel product from the cavity. The channel has a closed end and a seal in the channel that is constructed and arranged such that the seal prevents a performance gel from flowing out of the channel when the flexible package is opened.

In an embodiment, the seal begins 1 to 20 millimeters from the bottom of the channel. Alternatively, the seal begins 2 to 3 millimeters from the bottom of the channel.

In an embodiment, the seal is located in either the top third of the channel, the center of the channel, or the bottom third of the channel.

In an embodiment, the seal has a shape selected from the group consisting of a curve, circle, square, rectangle, triangle, v-shape, or combinations thereof.

In an embodiment, the seal is substantially v-shaped.

In an embodiment, the v-shaped seal is comprised of acute angles.

In an embodiment, the flexible package has only one seal. Alternatively, the flexible package has multiple seals.

In an embodiment, there is a seal on either side of the channel.

In an embodiment, the flexible package has more than one seal and all the seals are the same shape. Alternatively, the seals are different shapes.

In an embodiment, the seal blocks the channel by causing the channel to bend.

In an embodiment, the channel is centered along the width of the flexible package. Alternatively, the channel is off-center along the width of the package.

In an embodiment, the channel is about 8 to 10 millimeters at its widest point.

In an embodiment, the channel is 6 to 9 millimeters at its narrowest point.

In an embodiment, the length of the channel is about 3 or 3.5 times the width of the channel.

In an embodiment, the channel has a shape selected from the group consisting of square, rectangular, cylindrical, or combinations thereof.

In an embodiment, the channel forms and angle of about 65 degrees between the channel and the body of the package.

In an embodiment, the flexible package has a shape selected from the group consisting of square, circle, triangle, pentagon, hexagon, heptagon, octagon, nonagon, decagon, hendecagon, dodecagon, or combinations thereof.

In an embodiment, the flexible package is a pouch.

In an embodiment, the body comprises at least two composite layers sealed together. The at-least two layers may be heat-sealed together.

In an embodiment, the body is made of flexible laminate.

In yet another embodiment, methods for administering a flowable consumable product to a consumer in need of same are provided. The methods include providing a flexible package having a body defining a cavity for housing a flowable product and a channel for dispensing the flowable product from the cavity, the channel being closed on one end and including a releasable seal inside the channel. The methods further include sealing the channel using the releasable seal by applying light pressure to the flexible package and blocking the flowable consumer product from emerging during opening of the package, and opening the flexible package along the closed end of the channel. The method still further includes applying a stronger pressure to the flexible package to administer the flowable product to the consumer.

In an embodiment, the pressure is selected from the group consisting of pressing on the flexible package, squeezing the flexible package, shaking the flexible package, or combinations thereof.

In still yet another embodiment, methods for preventing a flowable product from flowing out of a flexible package are provided. The methods include providing a flexible package having a body defining a cavity for housing a flowable product and a channel for dispensing the flowable product from the cavity, the channel being closed on one end and blocked by a releasable seal. The methods further include applying pressure to the package, causing the seal to block the channel and preventing the flowable product from flowing out of the package.

In an embodiment, the pressure is administered by either pressing on the flexible package, squeezing the flexible package, shaking the flexible package, or combinations thereof.

In an embodiment, the seal begins 1 to 20 millimeters from the bottom of the channel. Alternatively, the seal begins 2 to 3 millimeters from the bottom of the channel.

In an embodiment, the seal is located in either the top third of the channel, the center of the channel, or the bottom third of the channel.

In an embodiment, the seal has a shape selected from the group consisting of a curve, circle, square, rectangle, triangle, v-shape, or combinations thereof.

In an embodiment, the seal is substantially v-shaped.

In an embodiment, the v-shaped seal is includes acute angles.

In an embodiment, the flexible package has only one seal. Alternatively, the flexible package has multiple seals.

In an embodiment, there is a seal on either side of the channel.

In an embodiment, the flexible package has more than one seal and all the seals are the same shape. Alternatively, the seals are different shapes.

In an embodiment, the channel has a closed portion at one end.

In an embodiment, the seal blocks the channel by causing the channel to bend.

In an embodiment, the channel is centered along the width of the flexible package. Alternatively, the channel is off-center along the width of the package.

In an embodiment, the channel is about 8 to 10 millimeters at its widest point.

In an embodiment, the channel is 6 to 9 millimeters at its narrowest point.

In an embodiment, the length of the channel is about 3 or 3.5 times the width of the channel.

In an embodiment, the channel has a shape selected from the group consisting of square, rectangular, cylindrical, or combinations thereof.

In an embodiment, the channel forms and angle of about 65 degrees between the channel and the body of the package.

In an embodiment, the flexible package has a shape selected from the group consisting of square, circle, triangle, pentagon, hexagon, heptagon, octagon, nonagon, decagon, hendecagon, dodecagon, or combinations thereof.

In an embodiment, the flexible package is a pouch.

In an embodiment, the body comprises at least two composite layers sealed together. The at-least two layers may be heat-sealed together.

In an embodiment, the body is made of flexible laminate.

In an embodiment, the flexible package is configured to house a flowable product selected from the group consisting of a gel, liquid, semi-liquid, or combinations thereof. The gel may be a performance gel.

It is an advantage of the present disclosure to provide improved consumable product containers.

It is also an advantage of the present disclosure to provide consumable product containers that prevent accidental spillage or leakage of flowable contents in the container while the package is being opened.

It is another advantage of the present disclosure to provide consumable product containers that prevent accidental spillage or leakage of flowable contents in the container while the product is being consumed.

It is a yet another advantage of the present disclosure to provide consumable product containers that are easily handled by consumers for consumption during physical activity.

It is a further advantage of the present disclosure to provide a neat and sanitary method of opening a flexible package containing a consumable gel or liquid.

Additional features and advantages are described herein, and will be apparent from the following Detailed Description and the figures.

DETAILED DESCRIPTION

Figure 1:
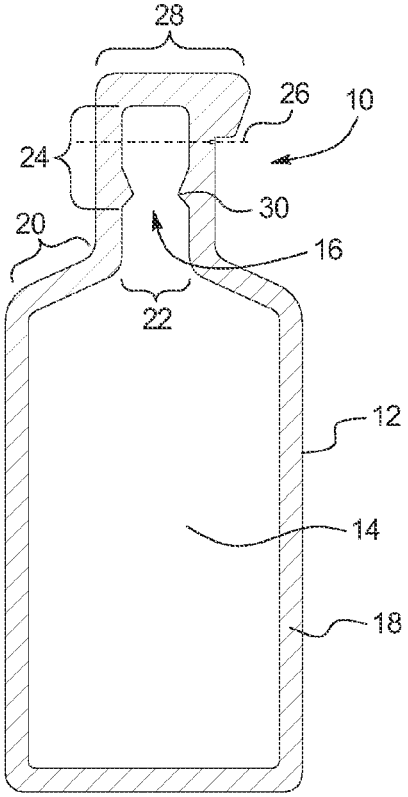
FIG. 1 illustrates a cross-sectional view of a flexible consumable product container in accordance with an embodiment of the present disclosure.

The present disclosure provides packages for housing consumable products. The packages may be custom designed for ease of use by consumers (e.g., athletes) before, during or after physical activity. For example, during vigorous physical activity, athletes desire to maintain appropriate levels of specific nutrients such as carbohydrates and electrolytes for improved or sustained athletic performance or increased mental alertness. It is known to provide such nutrition in, for example, performance bars. Although the performance bars provide individuals with adequate nutrition for prolonged or endurance performance, the individual may not enjoy consuming these types of performance bars. In this regard, the performance compositions may be difficult to consume during exercise or may be too dense or heavy for consumption before or during exercise, or may have a chalky or bland taste.

Alternatively, it is also known to provide adequate nutrition for prolonged or endurance performance in the form of gels. Such gels are typically found in flexible, pouch-like packaging and may be easily consumed by the athlete during performance of vigorous activity. In this regard, the only action required by the athlete is to either (i) press the flexible pouch to force the gel into the athlete's mouth, or (ii) to tip the gel package upside down so that gravity will allow the gel product to flow from the package naturally. However, when opening the package, even a slight pressure causes the gel contents to spill out, creating an inconvenient and unsanitary mess that is not appealing to an athlete attempting to consume a product during performance of vigorous activity. Also, if a less viscous, more liquid-like product were included in the package, simply tipping the package over would likely result in the loss of a large amount, if not all, of the product contained within the package. Thus, a gel package may be provided with an automatically blocking seal adapted to retain the gel in the package during opening and consumption.

The packages of the present disclosure provide flexible pouch-like package with automatically blocking releasable seals that prevent accidental spillage of a gel or other flowable consumer product either while the packages are being opened, or during consumption of the product. The consumable products housed by the packages may be any flowable consumable products including, for example, liquids, semi-solids, gels, etc. In an embodiment, the consumable product is a gel product used to support athletic performance. In an embodiment, the consumable product is a fruit and/or vegetable puree product used to support athletic performance. The teachings of the present disclosure, however, are not limited to gel or puree products and may include any products capable of flowing. The skilled artisan will appreciate that the viscosity of the product contained in the present packages or containers may be determined, at least in part, by temperature. For example, a substance at a high temperature may be less viscous, while the same substance at a low temperature may be more viscous.

In an embodiment, and as shown in FIG. 1, a package 10 for storing consumable products is provided. Package 10 includes a body 12 that defines a shape. The shape and size of body 12 is not critical and body 12 may have any size or shape known the skilled artisan. For example, body 12 may be a square, circle, triangle, pentagon, hexagon, heptagon, octagon, nonagon, decagon, hendecagon, dodecagon, or three-dimensional versions of any of the previously listed shapes, or combinations thereof. Body 12 is also not limited to a specific size, so long as body 12 is capable of housing a flowable consumable product.

Body 12 may be made from materials that are sealable and flexible such as, for example, flexible plastic films. Body 12 may be made of flexible laminate. In an embodiment, body 12 is a flexible pouch, which provides several advantages over rigid containers. For example, the shape of a flexible pouch adapts to available space, pouches are lighter in weight than rigid containers, when emptied of the contents, pouches require less space, when filled with contents, the thickness dimension is small, permitting faster processing times and mitigating heat damage to foods, they are not subject to corrosion or breakage, and they are easier to open by athletes during vigorous physical activity.

Body 12 may also be a flexible, composite package. In an embodiment, body 12 is a sealable, flexible, composite package having from about two to about four, or about three layers of substrates. The substrates may include, for example, a flexible plastic film, an impermeable layer, or combinations thereof. In an embodiment, body 12 includes an outer polymer layer that is resistant to wear and tear, an inner polymer layer that is resistant to wear and tear and seals well, and a middle aluminum foil layer for eliminating light from the contents as well as for making the pouch material impermeable to gases. The layers may be bonded together with an adhesive. In an embodiment, body 12 is formed from two layers (i.e., single or composite) comprising flexible plastic films that are sealed together. In an embodiment, body 12 has composite layers that are heat-sealed together.

Body 12 is so constructed and arranged to house a flowable, consumable product in cavity 14 that includes a channel 16 for dispensing a flowable, consumable product from cavity 14. The shape of cavity 14 and channel 16 are defined, at least in part, by a sealed portion 18 of body 12. Sealed portion 18 is formed from a top layer and a bottom layer (i.e., single or composite layers) comprising flexible plastic films that are sealed together to form body 12. In other words, the shape and size of cavity 14 and channel 16 are determined by the portions of the top layer and the bottom layer that are not sealed together.

In an embodiment, sealed portion 18 may be a heat-sealed portion. The sealed portion may be of various widths determined by the other measurements of the package. By providing sealed portion 18 at a sufficient width, package 10 can better withstand common wear and tear that occurs during packaging, shipping and retail display. In this regard, a sufficient width of sealed portion 18 will ensure that package 10 cannot be accidentally torn open, thereby contaminating the consumable product.

In an embodiment, cavity 14 has a substantially rectangular shape that is formed from sealed portions 18. As is also shown in FIG. 1, channel 16 and body 12 form an angle pictured as shoulder 20. In an embodiment, the angle is between 45 and 90 degrees. In another embodiment, the angle is about 65 degrees. The shape of body 12, shoulder 20, and channel 16 helps a flowable, consumable product housed in cavity 14 to flow smoothly from cavity 14 toward and into channel 16 to be dispensed from package 10.

In an embodiment, channel 16 has a width 22 and a length 24. With respect to width 22 of channel 16, Applicant has surprisingly found that width 22 should be within a range from about 6 mm to about 10 mm, or from about 7 mm to about 9 mm, or about 8 mm. Width 22 may be constant along length 24 of channel 16, or may vary along length 24. In an embodiment, width 22 varies from 8 to 10 millimeters at its widest point and 6 to 9 millimeters at is narrowest point along length 24 of channel 16. In another embodiment, channel 16 has length 24 that is 2 to 4 times the width 22. In another embodiment, length 24 is 3 to 3.5 times the width 22 of channel 16. Once flow begins through channel 16, channel 16 becomes a three-dimensional structure having a radius (not illustrated).

The skilled artisan will appreciate that the dimensions of channel 16 may vary as desired or in accordance with manufacturing specifications or in accordance with the size and shape of the consumable products contained therein. The shape may also vary. In an embodiment, channel 16 is square, rectangular, or cylindrical.

Channel 16 may be located wherever is most appropriate to maximize ease of consumption of the flowable product contained in package 10. In an embodiment, channel 16 is centered along a width of package 10. In another embodiment, channel 16 is off-centered along a width of package 10.

As mentioned above, placement of channel 16 may slightly change dimensions of channel 16. For example, channel 16 is centered in FIG. 1. If channel 16 is off-center, Applicant believes that there then may be slightly more resistance to flow through channel 16 than if channel 16 were placed in the center of a side of package 10. Accordingly, a small change in dimensions may be necessary to optimize a length of channel 16.

In an embodiment, package 10 may be provided with a tear line 26 to assist a consumer in easily opening package 10 to release product from channel 16. Package 10 is opened by removing one end of Channel 16. This end is closed end 28. Closed end 28 may be sealed with adhesive, or heat sealed, or otherwise closed in any appropriate matter known to the skilled artisan. In an embodiment, closed end 28 is heat sealed.

Tear line 26 may be perforated or scored for easy tearing by the consumer, and may include a pre-torn portion at an edge of tear line 26 to aid in initiating a tear to remove closed end 28. Removal of closed end 28, even with assistance of tear line 26, requires that pressure be exerted on package 10 by the consumer of the flowable consumer product in package 10. The pressure is the pressure exerted by holding the package and by tearing or otherwise removing closed end 28. The exertion of even this slight, low pressure will lead to the contents of package 10 leaking out of the package and making an unsanitary mess. Applicant has surprisingly found that leakage of a flowable product from cavity 14 and channel 16 may be prevented without interfering with the consumption of the product by placing releasable seal 30 in channel 16.

Figure 2:
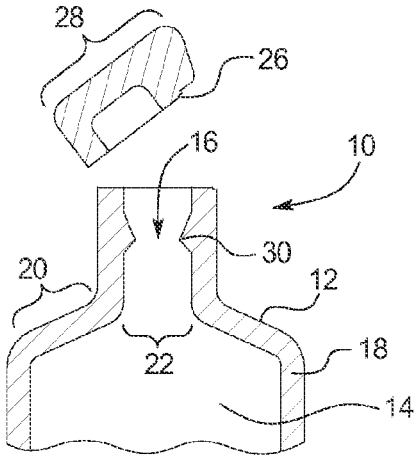
FIG. 2 illustrates the top of the flexible consumable product container of FIG. 1 after opening the container.

As shown in FIG. 2, releasable seal 30 allows a consumer to remove closed end 28 from channel 16. As illustrated in the Figure, flowable consumable product 32 did not emerge from channel 16 during the opening process. Without being bound to any theory, Applicant believes that releasable seal 30, upon application of slight, low pressure as is required to hold the package 10 or remove closed end 28, blocks channel 16 by causing the channel to bend.

Figure 3:
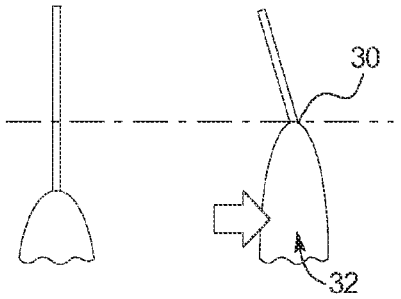
FIG. 3 illustrates a diagram demonstrating the seal of the flexible consumable product container of FIG. 1 after light pressure has been applied to the package, causing the seal to block the channel of the container.

As illustrated in FIG. 3, as consumable product 32 enters into channel 16 from the slight pressure exerted by the consumer on package 10, it presses against releasable seal 30, bending channel 16 inward. In FIG. 3, releasable seal 30 is a v-seal. The skilled artisan will appreciate that the seal may be any shape that allows channel 16 to be blocked while package 10 is held and opened, but unblocked when the consumer dispenses flowable product 32. Releasable seal 30 may be a curve, circle, square, rectangle, triangle, v-shape, etc. In an embodiment, releasable seal 30 is a v-shape comprised of acute angles.

Without being held to any theory, Applicant believes that when stronger, heavier pressure is exerted on package 10, such as the pressure created by squeezing the package to dispense flowable product 32, releasable seal 30 will unblock the channel. In an embodiment, channel 16 will become unblocked by becoming straight, allowing flowable product 32 to pass through without impediment.

A certain amount of force or pressure is required to be applied to the presently claimed packages in order to dispense flowable product 32 from package 10. A sufficient amount of force may be provided by the consumer by pinching or squeezing package 10 between the fingers of the consumer. Additionally, the force required may depend on the viscosity of the flowable consumable product contained within package 10, or the temperature of the package containing a flowable consumable product. In this regard, the flowable consumable product may be more liquid at warmer temperatures thereby requiring a lesser force to dispense the product. Alternatively, the flowable consumable product may be more gel-like at colder temperatures thereby requiring a greater force to dispense the product. Regardless, Applicant has surprisingly found that releasable seal 30 allows twice as much pressure to be applied to package 10 without leakage or mess during opening as compared to packages without a releasable seal in the channel. The presence of releasable seal 30 in the channel enhances the consumption experience for an athlete consuming performance gel from package 10 during vigorous activity.

The skilled artisan will appreciate that releasable seal 30 may be located in various places along channel 16. Seal 30 may be located in the top third of the channel, or the bottom third of the channel, or the center of the channel. Depending on the length 24 of channel 16, releasable seal 30 may be located 1 to 20 millimeters from the bottom of the channel. In an embodiment, releasable seal 30 may be located 2 to 3 millimeters from the bottom of the channel. The precise location of the seal will depend upon the various configurations and dimensions of the rest of package 10, and, in particular, channel 16.

Releasable seal 30 may be one seal, or multiple seals. If there are multiple seals, the seals may be the same shapes or different shapes. The skilled artisan will appreciate the seals may be aligned across from each other along channel 16 or located in different sections of the channel depending on what arrangement is most efficient to block and unblock channel 16 as needed. In an embodiment, as pictured in FIGS. 1 and 2, channel 16 contains two releasable seal 30*s* across from each other on either side of channel 16. Both seals are v-shaped.

As an additional feature, package 10 may include indicia (not illustrated) provided on an exterior of body 12 for marketing purposes. The indicia may include, for example, logos, advertisements, branding information, nutritional information, product information, manufacturer information, etc. The indicia may be printed on a pressure sensitive material, printed directly on package 10, printed on a removable closure, etc.

In sum, the packages of the present disclosure provide improved construction so as to prevent accidental spillage or leakage of a flowable consumable product housed therein while the product is being opened, yet still allowing easy consumption of the product after opening.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A flexible package comprising:

a pair of flexible, impermeable layers sealed to form a body defining a cavity for housing a flowable product and a channel, in fluid communication with the cavity, for dispensing the flowable product from the cavity, the channel having a bottom adjacent the cavity and a closed end opposite the bottom, the closed end being removable to form an open end and permit the flowable product to be dispensed from the cavity through the channel, the channel having a width extending from one sealed portion to an opposing sealed portion, a length extending from the bottom to the closed end, and an area of reduced width to impede the flow of the flowable product from the bottom of the channel to the open end thereof when the closed end is removed, wherein the width of the channel is substantially constant on each side of the area of reduced width, and wherein the width of the channel on one side of the area of reduced area is substantially the same as the width of the channel on the other side of the area of reduced width.

2. The flexible package according to claim 1, wherein the area of reduced width is formed by a pair of substantially v-shaped portions of the body extending inwardly into the channel.

3. The flexible package according to claim 1, wherein the channel is 8 to 10 millimeters at its widest point.

4. The flexible package according to claim 1, wherein the channel is 6 to 9 millimeters at its narrowest point.

5. The flexible package according to claim 1, wherein the length of the channel is about 3 times the width of the channel.

6. The flexible package according to claim 1, wherein the flexible package is a pouch.

7. The flexible package according to claim 1, wherein the body is configured to house at least one of: at least one performance gel, at least one fruit puree, at least one vegetable puree, or combinations thereof.

* * * * *